US005733438A

United States Patent [19]

Tong et al.

[11] Patent Number: 5,733,438

[45] Date of Patent: Mar. 31, 1998

[54] COKE INHIBITORS FOR PYROLYSIS FURNACES

[75] Inventors: Youdong Tong, Houston; Michael K. Poindexter, Sugar Land; C. Tom Rowe, Missouri City, all of Tex.

[73] Assignee: Nalco/Exxon Energy Chemicals, L.P., Sugar Land, Tex.

[21] Appl. No.: 547,639

[22] Filed: Oct. 24, 1995

[51] Int. Cl.[6] ..... C10G 9/16

[52] U.S. Cl. ..... 208/48 R; 585/648; 585/950

[58] Field of Search ..... 208/48 R, 48 AA; 585/648, 950

[56] References Cited

U.S. PATENT DOCUMENTS

| | | | |
|---|---|---|---|
| 3,342,723 | 9/1967 | Godar | 208/48 |
| 4,024,048 | 5/1977 | Shell et al. . | |
| 4,024,049 | 5/1977 | Shell et al. . | |
| 4,024,050 | 5/1977 | Shell et al. . | |
| 4,024,051 | 5/1977 | Shell et al. . | |
| 4,105,540 | 8/1978 | Weinland . | |
| 4,176,045 | 11/1979 | Leftin et al. . | |
| 4,226,700 | 10/1980 | Broom . | |
| 4,599,480 | 7/1986 | Buddell et al. . | |
| 5,221,462 | 6/1993 | Reid et al. | 208/48 AA |

FOREIGN PATENT DOCUMENTS 222 324 A1 12/1983 German Dem. Rep. .

OTHER PUBLICATIONS

"Thermal Hydrocarbon Chemistry", Adv. in Chemistry Series 183 (1979) L. F. Albright/Y-H. C. Yu.

"Coal Gasification", Adv. in Chemistry Series, P. S. Virk, et al., 131:237 (1974).

"The Mechanism of Thermal Decomposition of the Normal Olefins", The Chemical Society, Wheeler/Wood 1819 (1930).

"Coking Rates in a Laboratory Pyrolysis Furnace: Liquid Petroleum Feedstocks", Ind. Eng. Chem. Res. 1987, 26, 1003–1010, Leftin/Newsome.

"Secondary Reactions of Olefins in Pyrolysis of Petroleum Hydrocarbons", Adv. in Chemistry Series 97, 1970, Sakai/Soma/Sasaki/Tominaga/Kinugi.

"Tendencies of Aromatization in Steam Cracking of Hydrocarbons", Ind. Eng. Chem. Res. 1987, 26, 2393–2397, Kopoinke/Zimmermann/Ondruschka.

*Primary Examiner*—Glenn Caldarola
*Assistant Examiner*—Bekir L. Yildirim
*Attorney, Agent, or Firm*—Robert A. Miller; Kelly L. Cummings

[57] ABSTRACT

Aromatic compounds in small amounts function as antifoulant additives in pyrolysis furnaces which are subjected to elevated temperatures from about 500° C. to about 1200° C. when thermally convening hydrocarbons to ethylene as well as other useful products. These furnaces produce material that deposits and accumulates upon furnace surfaces including furnace radiant coils and transfer line exchangers. The present antifoulant additives inhibit and suppress the formation and deposition of material on furnace surfaces. The present invention is a method for inhibiting the formation of coke on the surfaces of a radiant heating section of a pyrolysis furnace and the surfaces immediately downstream of such section in contact with a hydrocarbon feedstock which comprises decoking the pyrolysis furnace, and prior to processing the hydrocarbon feedstock, adding an inhibiting compound to the pyrolysis furnace. The inhibiting compound is selected from the group consisting of substituted benzenes, substituted naphthalenes, substituted anthracenes, substituted phenanthrenes, and mixtures thereof wherein the inhibiting compound contains at least one substitutent having at least 2 carbon atoms. A thin catalytically inactive coke layer is formed on the surfaces of the pyrolysis furnace. The hydrocarbon feedstock is then fed into the furnace, whereby the surfaces of the furnace are inhibited against the formation of a catalytically active coke during the processing of the hydrocarbon feedstock.

29 Claims, 2 Drawing Sheets

COKE INHIBITORS FOR PYROLYSIS FURNACES

FIELD OF THE INVENTION

The invention relates to the production of ethylene and similar products by steam pyrolysis of hydrocarbon feedstocks in a pyrolysis furnace and, more particularly, to the inhibition of coke deposits on the surfaces of the radiant heating section of the furnace and surfaces immediately downstream from such sections in contact with the hydrocarbon feedstock and by-products of the pyrolysis reactions during the processing of the hydrocarbon feedstock.

BACKGROUND OF THE INVENTION

Ethylene manufacture entails the use of pyrolysis furnaces (also known as steam crackers or ethylene furnaces) to thermally crack various gaseous and liquid petroleum feedstocks to manufacture ethylene as well as other useful products. Typical gaseous feedstocks include ethane, propane, butane, and mixtures thereof. Typical liquid feedstocks include naphtha, kerosene, gas oil, and mixtures thereof.

The hydrocarbon feedstocks are cracked in the tube reactors of a pyrolysis furnace typically at temperatures ranging from 700° to 1100° C. Steam is generally used in the cracking reactions to control undesired reactions or processes, such as coke formation. The hydrocarbon feedstocks and the steam are mixed and preheated when they pass through the convection section of the pyrolysis furnace. The cracking reactions of the hydrocarbon feedstocks occur in the radiant section of the pyrolysis furnace. The cracked product effluent from the radiant section is quenched through transfer line exchangers (TLEs) and oil and/or water quench towers, and then it is fractionated and purified in the downstream processes to desired products. In general, ethylene is the major and the most desired of the products.

Metal alloys containing high nickel, iron, and chromium are widely used in industry as the construction materials for the furnace tubes to withstand the high temperature and extreme operating environments. However, nickel and iron are also well known catalysts for the reactions leading to the formation of coke deposition.

Coke deposits are by-products of the cracking reactions. Even though the reactions leading to coke deposition are not significant relative to those that produce the desired products, the amount of the coke formed is enough to make coke deposition a major limitation for the pyrolysis furnace operation. Fouling of the furnace reactor coils and TLEs occurs because of coke deposition. Coke deposition decreases the effective cross-sectional area of the process stream, which increases the pressure drop across the furnace reactors and TLEs. The pressure buildup in the reactor adversely affects the yield of ethylene.

Additionally, since coke is a good thermal insulator, the buildup of coke on the inside surface of the reactor wall requires a gradual increase in furnace firing to ensure adequate heat transfer to maintain the desired conversion level. Eventually, tube skin temperature will reach the limit of the metal alloy, and lower conversion will be the consequence of insufficient heat flux. Also, higher metal tube temperatures accelerate reactor tube deterioration and shorten the tube life.

Depending on coke deposition rate, the cracking operations must be periodically terminated or shut down for cleaning (i.e., decoking). Cleaning operations are carried out either mechanically or by passing steam and/or air through the coils and TLEs to burn off the coke buildup. In addition to the periodic cleaning, crash shutdowns are sometimes required because of dangerous situations resulting from coke buildup in furnace reactor coils or TLEs. Run length, which is the operation time between the cleanings, averages from one week to four months depending in part upon the rate of fouling of the furnace reactor coils and TLEs. Any process improvement or chemical treatment that could reduce coke deposition and increase run length would obviously lead to higher production capacity, fewer days lost to cleaning, and lower operation and maintenance costs.

Extensive research has been carried out to understand the mechanisms of coke formation and to search for solutions of eliminating the coke deposition. Concerning the reactions contributing to coke formation, coke can be generally classified into two major categories: catalytic and non-catalytic coke. The reactions catalyzed by metals, such as dehydrogenation reactions, are the origins of the catalytic coke, while the non-catalytic coke is the product of certain interface radical reactions. In both cases, a physical contact between gas phase coke precursors and surface active sites is necessary. Thus, elimination of this physical contact will significantly lower the overall coke formation and deposition. One method to prevent this physical contact would be to build an effective, catalytically inactive physical barrier which would isolate gas phase coke precursors from active surface sites.

Chemical additives containing phosphorus, sulfur, aluminum, silicon, tin, bismuth, hydrocarbons, alkali and alkali earth metals, rare earth metals, and the like have been studied or used as coke inhibitors to reduce coke formation and deposition. It is believed that some of the coke inhibitors, such as those containing aluminum, silicon, and hydrocarbons, are based on the principle of generating a catalytically inactive physical barrier which isolates gas phase coke precursors from active surface sites. Of all the choices, hydrocarbons are more attractive because their use does not introduce any foreign elements into the process, as foreign elements in general raise concerns about their potential side effects.

It is known that coke may be catalytically active, promoting further coke formation, or catalytically inactive, inhibiting or reducing the rate of coke formation. The formation of catalytically active coke results in an auto-acceleration of the coking rate, while the formation of catalytically inactive coke results in at least a de-acceleration of the coking rate. The formation of the different cokes depends upon the hydrocarbon feedstock used in the pyrolysis process. A catalytically active coke is formed when acetylene is used as a feedstock. Such coke acts as a catalyst for further coke formation. Catalytically inactive coke is formed when a butadiene or benzene feedstock is used in a pyrolysis process. Such catalytically inactive coke reduced the coke formation rate. Catalytically active coke has been found to contain a considerable amount of metal granules. Therefore, it would be desirable to generate a layer of catalytically inactive coke, as such a coke layer may serve the purpose of a physical barrier to isolate the coke precursors in the hydrocarbon feedstock and pyrolysis by-products from contacting active surface sites.

Leftin et al., U.S. Pat. No. 4,176,045, teaches a method to minimize coke deposition in the production of lower olefins by co-cracking a low-coking hydrocarbon with a feedstock having a high-coking tendency. It claimed that such blending would result in a low-coking hydrocarbon feedstock if a proper blending ratio is chosen. The coking tendency is determined by the Coking Inhibition Index which depends on specific gravity, sulfur content, and aromaticity. The Leftin reference did not address the issues concerning the fouling of the convection section of the furnace and the TLEs as well as any downstream operation when co-processing two hydrocarbons which differ in gravity, sulfur content, and aromaticity. In a later publication, Leftin and Newsome attributed the inhibition potential of the low-coking hydrocarbons to their ability to form an amorphous coke deposit which encapsulates catalytically active metal sites.

Bach et al., DD Pat. No. 222,324, teaches a method of reducing carbon-rich solid deposits in the pyrolysis reactor without additional coke formation in the condensation and cooling system by adding between 1 and 30% toluene or toluene-containing fractions (at the C7 portion of naphtha) to feedstocks from ethane up to Vacuum Gas Oil (VGO). A reduction in coking by as much as 50% was reported, and in addition, an increase in the target products such as benzene, xylene, and styrene was obtained.

Buddell et al., U.S. Pat. No. 4,599,480, teaches a method in which two cracking feedstocks are used in a sequence. The first feedstock is selected from naphtha or gasoline boiling range or C3–C12 paraffin hydrocarbons. The second feedstock uses a lower paraffin than the paraffin used in the first feedstock. The first feedstock is cracked to place an amorphous relatively smooth layer of coke on interior walls of the thermal cracking tubes. To achieve a required thickness of this coke layer (between 1/16 and 1/8 inch), the first feedstock has to be on stream for a time as long as 11 days before operations can be switched to the second feedstock. Buddell did not address the impact of this sequential cracking of two different feedstocks on furnace operation, the fouling tendency in convection section of the furnace or the TLEs due to processing heavier feedstocks in the first cracking operation, and the adhesive property of the coke layer formed during the cracking of two different feedstocks.

Aromatics are well-known precursors for tar or coke formation. The higher coke formation tendency of certain heavy hydrocarbon feeds, such as gas oils, has been attributed to their higher aromatic content. In the case of cracking paraffinic materials, it is proposed that aromatics are generated through the cyclization of ethylene or propylene with higher di-olefins or the reactions of olefins with alkyl-type radicals. It would follow that aromatics are part of the least desirable components in a hydrocarbon feedstock because they are coke precursors, and as such, are of high coking tendency. It is least desirable to process a feedstock of a high aromatic content under a conventional cracking condition with respect to coke deposition.

A method could exist by which a catalytically inactive coke layer is formed on the surface of the radiant heating section and the surfaces immediately downstream from the radiant heating section that are in contact with a hydrocarbon feedstock and/or pyrolysis products during the processing of the hydrocarbon feedstock. The catalytically inactive coke layer, as an effective physical barrier between the coke precursors and active surface sites, would reduce the rate of coke formation, thereby, increasing run length and production levels of desired product. Ideally, this catalytically inactive coke layer could be formed using an effective amount of a coke inhibiting compound within an acceptable time, and more importantly, the formation of this layer would not generate any adverse side effects. In addition, the catalytically inactive coke layer could be formed without the addition of foreign elements which may result in additional concerns or detrimental side effects.

SUMMARY OF THE INVENTION

The invention is a method for inhibiting the formation of coke on the surfaces of the radiant heating sections in pyrolysis furnaces and the surfaces immediately downstream from such sections (e.g. TLEs) in contact with a hydrocarbon feedstock during the processing of the feedstock. The present invention is a method for inhibiting the formation of coke on the surfaces of a radiant heating section of a pyrolysis furnace and the surfaces immediately downstream of such section in contact with a hydrocarbon feedstock which comprises decoking the pyrolysis furnace and prior to processing the hydrocarbon feedstock, adding an inhibiting compound to the pyrolysis furnace. The inhibiting compound is selected from the group consisting of substituted benzenes, substituted naphthalenes, substituted anthracenes, substituted phenanthrenes, and mixtures thereof wherein the inhibiting compound contains at least one substitutent having at least 2 carbon atoms.

A thin catalytically inactive coke layer is formed on the surfaces of the pyrolysis furnace. The hydrocarbon feedstock is then fed into the furnace, whereby the surfaces of the furnace are inhibited against the formation of a catalytically active coke during the processing of the hydrocarbon feedstock.

The addition of the inhibiting compound is usually started prior to the processing of a hydrocarbon feedstock, and may be continued during the processing of a hydrocarbon feedstock. The addition of the inhibiting compound may be discontinued prior to or during the processing of the hydrocarbon feedstock, or it may be started during the processing of the hydrocarbon feedstock. The inhibiting compound may be added on a continuous or intermittent basis before or during the processing of a hydrocarbon feedstock.

DESCRIPTION OF THE INVENTION

Figure 1:
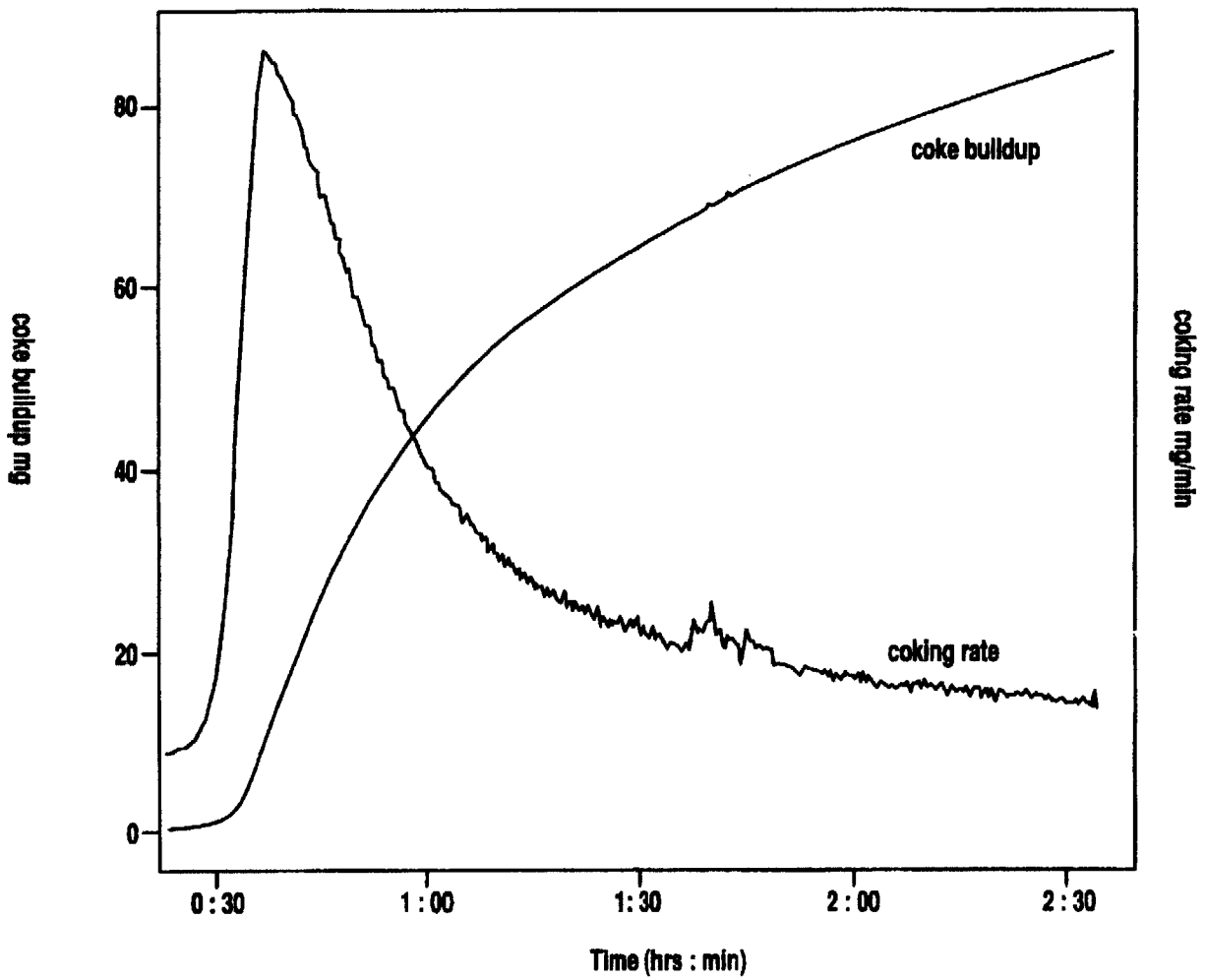
FIG. 1 shows the coke buildup and the corresponding coking rate with time on stream recorded by an electrobalance during a blank run.

The invention is a method for inhibiting the formation of coke on the surfaces of the radiant heating sections in pyrolysis furnaces and the surfaces immediately downstream from such sections (e.g. TLEs) in contact with a hydrocarbon feedstock during the processing of the feedstock. The term hydrocarbon feedstock, as used herein, is understood to also include the products of the pyrolysis reactions. The method for inhibiting the formation of coke on the surfaces of a radiant heating section of a pyrolysis furnace and the surfaces immediately downstream of such section in contact with a hydrocarbon feedstock comprises decoking the pyrolysis furnace and prior to processing the hydrocarbon feedstock, adding an inhibiting compound to the pyrolysis furnace. The inhibiting compound is selected from the group consisting of substituted benzenes, substituted naphthalenes, substituted anthracenes, substituted phenanthrenes, and mixtures thereof wherein the inhibiting compound contains at least one substitutent having at least 2 carbon atoms.

A thin catalytically inactive coke layer is formed on the surfaces of the pyrolysis furnace. The thickness of the coke layer can range from about a molecular thickness to a level of coke formation that does not substantially restrict the flow of the hydrocarbon feedstock through the pyrolysis furnace. The hydrocarbon feedstock is then fed into the furnace, whereby the surfaces of the furnace are inhibited against the formation of a catalytically active coke during the processing of the hydrocarbon feedstock. A thin catalytically inactive coke layer is also formed on the surfaces in contact with the hydrocarbon feedstock downstream of the radiant heating section of the pyrolysis furnace.

Some examples of the inhibiting compound include, but are not limited to, ethylbenzene, n-propylbenzene, i-propylbenzene, n-butylbenzene, and t-butylbenzene. The β-carbon of the two carbon substituent may also be replaced with a heteroatom, such as nitrogen, oxygen, and sulfur. Some examples include, but are not limited to, benzylamines, benzyl alcohols, benzyl mercaptans, and benzyl alkyl sulfides.

The addition of inhibiting compound to the pyrolysis furnace can be started prior to the processing of a hydrocarbon feedstock, and may be continued during the processing of a hydrocarbon feedstock, or may be started during the processing of the hydrocarbon feedstock. The inhibiting compound may be added to the furnace on a continuous or intermittent basis prior to or during the processing of a hydrocarbon feedstock. The addition of the inhibiting compound may be discontinued prior to or during the processing of the hydrocarbon feedstock.

The inhibiting compound may be further defined as having the following formulae:

I.

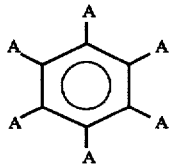

II.

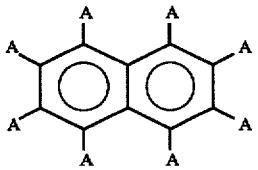

III.

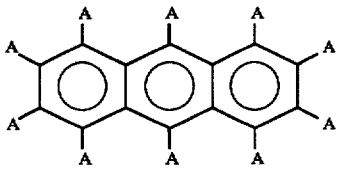

IV.

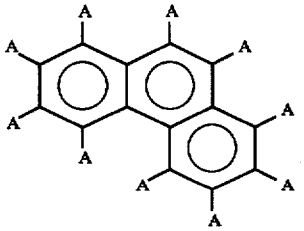

A is selected from the group consisting of hydrogen and Z wherein at least one occurrence of A must be Z. Z is a substituent having the formula:

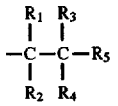

wherein $R_1$, $R_2$, $R_3$, $R_4$, and $R_5$ may be the same as or different from each other and are independently selected from the group consisting of hydrogen, alkyl, alkene, cycloalkyl, alkyne, alkylaryl, aryl, arylalkyl, and substituents containing heteroatoms selected from the group consisting of nitrogen, oxygen, and sulfur. $R_1$, $R_2$, $R_3$, $R_4$, and $R_5$ each may contain up to 15 carbon atoms.

Alternatively, the inhibiting compound may be further defined as having the following formulae:

I.

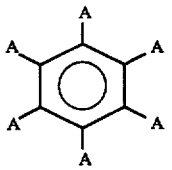

II.

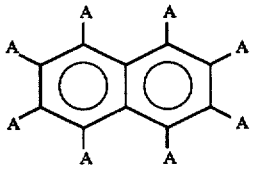

III.

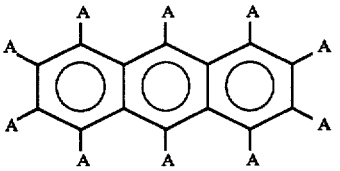

IV.

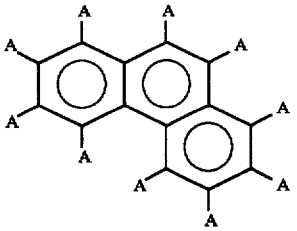

A is selected from the group consisting of hydrogen and Z wherein at least one occurrence of A must be Z. Z is a substituent having the formula:

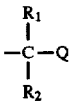

wherein Q is selected from the group consisting of: $NR_3R_4$, S—$R_3$, O—$R_3$, hydrogen, alkyl, alkene, cycloalkyl, alkyne, alkylaryl, aryl, arylalkyl, and substituents containing heteroatoms selected from the group consisting of nitrogen, oxygen, and sulfur. $R_1$, $R_2$, $R_3$, and $R_4$ may be the same as or different from each other and are independently selected from the group consisting of hydrogen, alkyl, alkene, cycloalkyl, alkyne, alkylaryl, aryl, arylalkyl, and substituents containing heteroatoms selected from the group consisting of nitrogen, oxygen, and sulfur. $R_1$, $R_2$, $R_3$, $R_4$, and Q may each contain up to 15 carbon atoms. However, $R_1$, $R_2$, and Q are not each a hydrogen atom at the same time.

The inhibiting compound may be formulated in an organic solvent or an aqueous solution. The inhibiting compound may be added to the furnace in a carrier selected from the group consisting of steam, hydrocarbon gases, inert gases, and mixtures thereof. The term carrier as used herein, includes the fluids or gases that are typically present in the furnace environment as well as fluids or gases that may be added specifically to carry the inhibiting compound into the furnace. During the addition of the inhibiting compound to the pyrolysis furnace, the furnace is maintained at a temperature ranging from about 500° to about 1200° C., and more preferably, at a temperature ranging from about 700° to about 1100° C. The hydrocarbon feedstock includes at least one fraction selected from the group consisting of ethane, propane, butane, naphtha, kerosene, and gas oil.

In another embodiment of the invention, the method comprises processing a hydrocarbon feedstock in the presence of an inhibiting compound selected from the group consisting of substituted benzenes, substituted naphthalenes, substituted anthracenes, substituted phenanthrenes, and mixtures thereof. The inhibiting compound contains at least one substituent having at least 2 carbon atoms.

A thin catalytically inactive coke layer is formed on the surfaces of the pyrolysis furnace, whereby the surfaces of the furnace are inhibited against formation of a catalytically active coke during the processing of a hydrocarbon feedstock. A thin catalytically inactive coke layer is also formed on the surfaces in contact with the hydrocarbon feedstock downstream of the radiant heating section of the pyrolysis furnace.

As stated above, the inhibiting compound may be further defined as having the following formulae:

I.

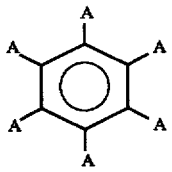

II.

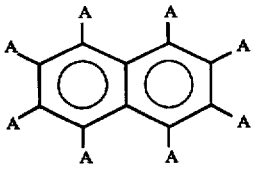

III.

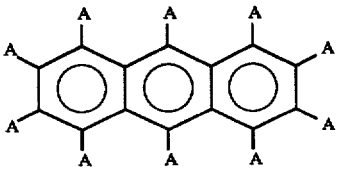

IV.

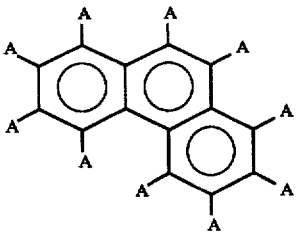

A is selected from the group consisting of hydrogen and Z wherein at least one occurrence of A must be Z. Z is a substituent having the formula:

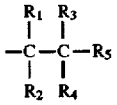

wherein $R_1$, $R_2$, $R_3$, $R_4$, and $R_5$ may be the same as or different from each other and are independently selected from the group consisting of hydrogen, alkyl, alkene, cycloalkyl, alkyne, alkylaryl, aryl, arylalkyl, and substituents containing heteroatoms selected from the group consisting of nitrogen, oxygen, and sulfur. $R_1$, $R_2$, $R_3$, $R_4$, and $R_5$ each may contain up to 15 carbon atoms.

Alternatively, the inhibiting compound may be further defined as having the following formulae:

I.

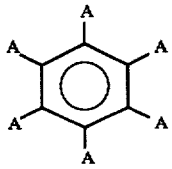

II.

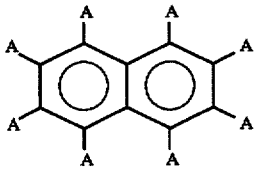

III.

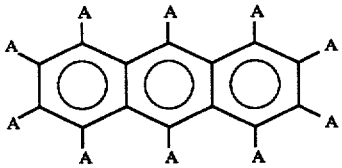

IV.

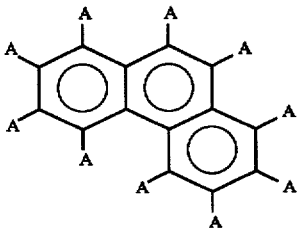

A is selected from the group consisting of hydrogen and Z wherein at least one occurrence of A must be Z. Z is a substituent having the formula:

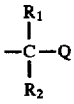

wherein Q is selected from the group consisting of: $NR_3R_4$, S—$R_3$, O—$R_3$, hydrogen alkyl, alkene, cycloalkyl, alkyne, alkylaryl, aryl, arylalkyl, and substituents containing heteroatoms selected from the group consisting of nitrogen, oxygen, and sulfur. $R_1$, $R_2$, $R_3$, and $R_4$ may be the same as or different from each other and are independently selected from the group consisting of hydrogen, alkyl, alkene, cycloalkyl, alkyne, alkylaryl, aryl, arylalkyl, and substituents containing heteroatoms selected from the group consisting of nitrogen, oxygen, and sulfur. $R_1$, $R_2$, $R_3$, $R_4$, and Q each may contain up to 15 carbon atoms. However, $R_1$, $R_2$, and Q are not each a hydrogen atom at the same time.

Another embodiment of the invention is a method for increasing the run length of the pyrolysis furnace used to process hydrocarbon feedstock which comprises decoking the pyrolysis furnace, and prior to processing the hydrocarbon feedstock, adding an inhibiting compound to the furnace. The inhibiting compound is selected from a group consisting of substituted benzenes, substituted naphthalenes, substituted anthracenes, substituted phenanthrenes, and mixtures thereof. At least one substituent of the inhibiting compound contains at least 2 carbon atoms. A thin catalytically inactive coke layer is formed on the surfaces of the pyrolysis furnace having contact with the hydrocarbon feedstock. The hydrocarbon feedstock is then fed into the furnace. The surfaces of the furnace are inhibited against the formation of catalytically active coke during the processing of the hydrocarbon feedstock thereby increasing the run length of the pyrolysis furnace.

An additional embodiment of the invention is a method for increasing the product yield from the processing of a hydrocarbon feedstock through a pyrolysis furnace which comprises decoking the pyrolysis furnace, and prior to processing a hydrocarbon feedstock, adding to the pyrolysis furnace an inhibiting compound selected from the group consisting of substituted benzenes, substituted naphthalenes, substituted anthracenes, substituted phenanthrenes, and mixtures thereof. At least one substituent of the inhibiting compound contains at least 2 carbon atoms. A thin catalytically inactive coke layer is formed on the surfaces of the pyrolysis furnace having contact with the hydrocarbon feedstock. The hydrocarbon feedstock is then fed into the furnace. The surfaces of the furnace are inhibited against the formation of catalytically active coke during the processing of the hydrocarbon feedstock thereby increasing the product yield from the processing of the hydrocarbon feedstock through the pyrolysis furnace.

The present invention discloses a method of using aromatic-containing inhibiting compounds and a discovery of the most effective formula of aromatics to reduce the coke deposition in pyrolysis furnaces in which hydrocarbon feedstocks are thermally converted to ethylene as well as other useful products at temperatures ranging from 700° to 1100° C. By combining this method and an effective formula, a significant reduction in coke deposition is achieved.

In this method, the additive treatment starts during a stand-by which is the time between furnace decoking and the introduction of hydrocarbon feedstock. Conventionally, during stand-by, steam is continuously being added to the furnace. A sufficient amount of the aromatic-based coke inhibiting compound is brought in contact with the radiant coil reactor surface of a pyrolysis furnace for a certain time prior to processing a hydrocarbon feedstock (pretreatment). During the pretreatment, the operation conditions are generally mild relative to those under which hydrocarbon feedstocks are processed, i.e., lower temperature (stand-by temperature) and steam dominated environment (because no hydrocarbon feedstock is present). This mild operation condition is very important for the development of a low defect, stable and effective catalytically inactive coke layer.

The addition of the coke inhibiting compound may be continued through start-up of the processing of the hydrocarbon feedstock. Preferably, the addition is terminated at a certain point where a steady cracking operation condition is reached, even though continuous or intermittent addition is also acceptable.

The aromatic inhibiting compounds are used to treat the inner surface of the radiant section reactor tubes of the pyrolysis furnace and inner surfaces of sections downstream of the radiant section reactor which are in contact with the hydrocarbon feedstock. By adding the inhibiting compound, a thin catalytically inactive coke layer is formed on the surfaces of the pyrolysis furnace. The thickness of the coke layer can range from about a molecular thickness to a level of which does not substantially restrict the flow of the hydrocarbon feedstock through the pyrolysis furnace. The catalytically inactive coke layer prevents coke precursors from contacting the surface of the pyrolysis furnace during the processing of a hydrocarbon feedstock, and thus, inhibits the formation of catalytically active coke, whereby the coke formation and deposition on the surfaces of the furnace is reduced during processing of the hydrocarbon feedstock. A thin catalytically inactive coke layer is also formed on the surfaces in contact with the hydrocarbon feedstock downstream of the radiant heating section of the pyrolysis furnace.

The inhibiting compound is usually started prior to the processing of a hydrocarbon feedstock. The addition of the inhibiting compound may be discontinued prior to or during the processing of the hydrocarbon feedstock. It is preferred that the addition of the inhibiting compound is terminated once a steady operating condition is established during the processing of the hydrocarbon feedstock. The addition of the inhibiting compound may also be started during the processing of the hydrocarbon feedstock. The inhibiting compound may be added on a continuous or intermittent basis before and/or during the processing of a hydrocarbon feedstock.

The possible point of injection of the inhibiting compound is unimportant as long as fouling due to the presence of the inhibiting compound is not a concern. Where fouling due to the presence of the inhibiting compound is a concern, such as in the convection section of the furnace, the inhibiting compound is preferably added to the furnace from anywhere after the place where hydrocarbon and dilution steam are mixed together but before the inlet to the radiant section. In general, it is most preferred to install the injection nozzles as close to the radiant section as possible. The objective of selecting injection locations is to ensure that no adverse effect, such as fouling in the early convection section such as that caused by insufficient vaporization, will occur from the use of the inhibiting compounds.

The surfaces can be treated with the inhibiting compound in several different ways, including for example, pretreating the surfaces prior to admitting hydrocarbon feedstocks (pretreatment), or continuously or intermittently adding the inhibiting compound to the hydrocarbon feedstock as it is being processed (continuous or intermittent treatment). A combination of the pretreatment with either the continuous or the intermittent treatment is preferred.

A pretreatment is conducted during the stand-by after decoking and prior to admitting hydrocarbon feedstocks. During a pretreatment, the inhibiting compound is carried into the furnace by a carrier. Preferred dosage ranges from 100 pans per million (ppm) up to 50% on the basis of the carrier mass flow, more preferably from 1000 ppm to 20%.

During a continuous or intermittent treatment, the aromatics are preferably added at a rate from about 100 ppm to 10% on the basis of the hydrocarbon feed mass flow, more preferably from about 1000 ppm to 1%. The dosage and the duration of the inhibiting compound treatment have to be carefully chosen and controlled. Excess use or extraordinary long addition of the inhibiting compound may result in too much coke deposition or fouling in radiant coils and/or TLEs.

The preferred inhibiting compounds are the molecules containing alkyl benzenes, alkyl naphthalenes, and alkyl triaromatics (such as anthracenes or phenanthrenes). The alkyl substituents may contain double or triple bonds, and/or heteroatoms other than carbon and hydrogen, and/or cycloalkyls as well as aryl groups. The inhibiting compounds may also contain more than one substituent per benzene ring (i.e., di, tri, or tetra substituted, etc). Using the treatment method disclosed above, the present invention found that most hydrocarbons, aromatics or paraffins, are effective to different extents in coke inhibition. However, the aromatic inhibiting compounds are generally more efficient than paraffinics.

The most important discovery of the present invention is that the most efficient coke inhibiting compounds of aromatics are those substituted aromatics from which benzyl-based radicals, Ph-$CR_1R_2$-, are easily formed under mild thermal conditions. $R_1$ and $R_2$ are H and/or alkyl groups. The alkyl substituent may contain heteroatoms other than hydrogen and carbon, as well as unsaturated and cycloalkyl moieties anywhere along the substituent as long as there is at least one carbon atom between the aromatic functional group and the heteroatom.

Even though alkyl naphthalenes and alkyl substituted polyaromatics are the preferred aromatics, care should be taken concerning their high melting and boiling points and their higher fouling tendency. The present invention recognized that coke inhibition efficiency could be further improved by blending alkyl aromatics of different structures. It is believed that the use of such aromatics will generate a well-packed, low defect coke layer which effectively isolates gas phase coke precursors from active surface sites.

The advantage of the aromatics-based coke inhibiting compounds over other type coke inhibitors is obvious to those familiar with the hydrocarbon pyrolysis processes. Most of the coke inhibitors in the current literature are based on applying certain chemicals or elements which are not typically present in the process stream. The introduction of such coke inhibitors into the process often raises concerns about their effect on reactor tube metallurgy, their interference with cracking reaction kinetics, their potential contamination on downstream processes, and their removal from the process. On the other hand, the use of the present aromatic-based coke inhibiting compounds does not have any of the concerns mentioned above because they do not introduce any foreign elements into the process, and aromatics are part of the cracked products.

The first contribution of this invention is the discovery of the most effective aromatics with respect to coking reduction. The effectiveness means that these inhibiting compounds can develop an effective catalytically inactive coke layer within a reasonable time.

The second contribution of this invention is the selection of the injection point. Aromatics are known fouling precursors, especially in an environment where only a small amount or no steam is present. This is often the situation in a convention section for most of the current pyrolysis furnaces. If the inhibiting compounds are improperly added before this section, fouling could occur in this section due to insufficient vaporization, which would adversely affect the operation of pyrolysis furnaces.

The third contribution of this invention is the treatment method and procedure. The invention recognized the importance of pretreatment and the additional benefits of a combination of pretreatment with either continuous or intermittent addition when using the inhibiting compounds as coke reduction additives. The invention also identified the proper conditions for pretreatment. The method ensures that the surface will be well passivated before contacting hydrocarbon feedstocks, and furthermore, the passivation will be preserved thereafter during the cracking operation.

The method also realizes the importance of terminating the addition of the inhibiting compound as soon as an effective catalytically inactive coke layer is established on the surfaces of the pyrolysis furnace. This is because extensive use of this inhibiting compound, either by high dosage or long addition duration, will make the coke layer too thick, which will raise concerns about coke spalling and plugging.

The following examples are presented to describe preferred embodiments and utilities of the invention and are not meant to limit the invention unless otherwise stated in the claims appended hereto.

The test method involved the utilization of a bench-scale laboratory cracking reaction unit which simulated the operations in a pyrolysis furnace. The furnace reactor of this simulation unit consisted of a stainless steel coil preheater (convection section), a quartz tube reactor (radiant section) and an electrobalance. A test coupon of Incoloy 800 alloy was suspended in the radiant section of the furnace reactor, and its weight was constantly recorded by the electrobalance. The weight increase during a cracking operation was an indication of coke deposition on the metal coupon. The typical output from the electrobalance was a plot of coke buildup vs. time on stream. A coking rate vs. time plot was obtained by differentiating the coke buildup vs. time plot.

Steam was always present in the process stream of the furnace reactor during hot stand-by, cracking run and decoking operations. A cracking run was initiated by introducing a hydrocarbon feedstock at a stand-by temperature (ca. 8000° C.). The radiant reactor temperature was then increased from the stand-by temperature to a cracking run temperature (from about 920° to about 940° C.) and then maintained at that temperature. The hydrocarbon feedstock was ethane with 40 ppm $H_2S$. The steam to hydrocarbon weight ratio was 0.30–0.35. The residence time was about 0.3 second for cracking run. A decoking operation was performed in an air-steam environment at about 800° to about 810° C.

A coke inhibitor additive was applied by introducing the additive at the front of the radiant reactor. The injection of the additive, the inhibiting compound, started within a certain time prior to admitting hydrocarbon feed. The addition was terminated after the cracking run reached a steady state.

Blank Experiments

A blank run, in which no coke inhibitor treatment was applied, is shown in FIG. 1 in terms of coke buildup vs. time, and the corresponding coking rate vs. time plot is given in the same figure. The initial fast increase in coking rate was due to the temperature ramp from the stand-by (8000° C.) to the cracking reaction (9400° C.) temperatures. After the coking rate reached its maximum at the end of the temperature ramp, a fast decline in coking rate was observed, which is consistent with conventional coking kinetics on an active metal surface. Generally, the change in coking rate was insignificant after two hours on stream, i.e., coking rate reached a steady state, asymptotic coking rate.

Additive Treated Runs

Under the same experimental conditions as the blank run shown above, several additives were evaluated regarding their efficiency on coke deposition reduction.

These additives were applied in the way described above. The additive treatments were continued through the start-up, and they were terminated after a steady cracking operation condition had been reached. Coking rates in Table 1 were recorded when a steady coking rate was reached. The percentage of coking rate reduction in Table 1 is defined as:

(1-ratio of coking rates of a treated run to a blank run)×100%

Additive A was a mixture of o-, m- and p-xylenes. Additive B was a mixture of aromatics, cycloalkanes and paraffins with a total aromatic content of 65%. Alkyl benzenes and alkyl naphthalenes were the major components in Additive B.

As Table I indicates, all the hydrocarbon additives showed inhibition of coke formation through this type treatment, and aromatics, in general, were more effective. Of the aromatics, the performance was significantly improved from toluene to t-butylbenzene. It was noticed that Additive A behaved quite similar to toluene, and it was also found that there was no notable difference between n-butylbenzene and t-butylbenzene concerning coke inhibition. The similarity between toluene and xylenes and between n-butylbenzene and t-butylbenzene and the difference between the methyl and the butyl substituted benzenes suggests that the performance depends on the ease of forming a benzyl radical, i.e., thermally, it is easier to generate a benzyl radical from butylbenzene than toluene or xylene. As Table I shows, the performance was further enhanced by using a mixture of alkyl benzenes and alkyl naphthalenes (Additive B).

It was also found that not all aromatics provided the same benefit, and some of them even showed adverse effect in coke inhibition. Naphthalene and styrene were such examples, and a significant increase in coking rate was observed when either one of them was used as a treatment additive.

Figure 2:
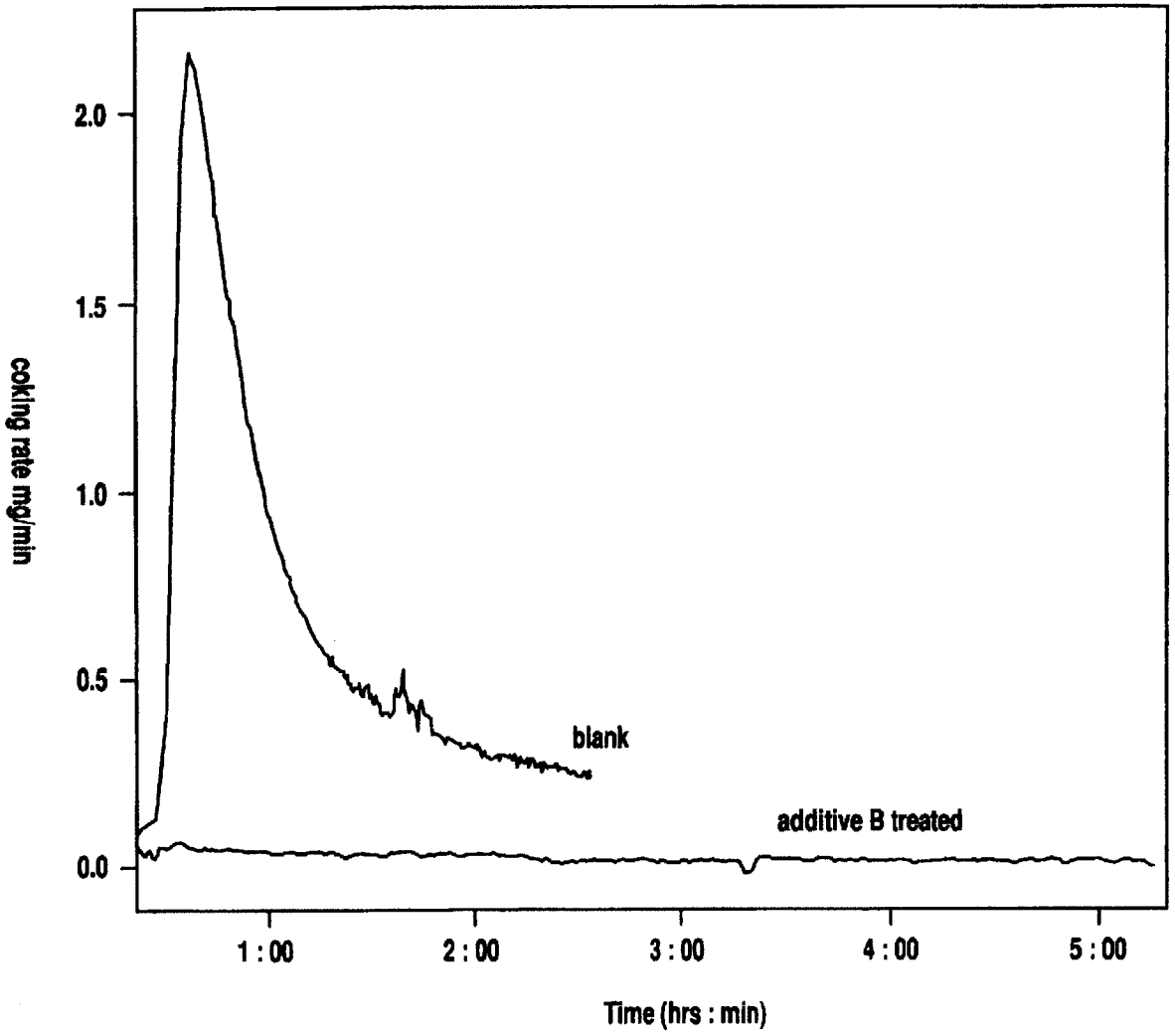
FIG. 2 is a coking rate vs. time on stream plot illustrating the anti-coking performance of additive B vs. the blank.

The influence of Additive B on overall coking rate is presented in FIG. 2, compared to the blank run. It is obvious that the Additive B treatment not only lowered the asymptotic coking rate (Table I), but also totally eliminated the initial fast coke build up regime.

TABLE I

REDUCTION IN COKING RATE

| ADDITIVES | COKING RATE REDUCTION, % |
|---|---|
| blank | 0 |
| n-pentane | 35 |
| n-dodecane | 35 |
| toluene | 43 |
| Additive A | 53 |
| t-butylbenzene | 85 |
| Additive B | 91 |

Changes can be made in the composition, operation and arrangement of the method of the present invention described herein without departing from the concept and scope of the invention as defined in the following claims:

We claim:

1. A method for inhibiting the formation of coke on the surfaces of a radiant heating section of a pyrolysis furnace and the surfaces immediately downstream of such section in contact with hydrocarbon feedstock which comprises:

a. decoking pyrolysis furnace;

b. prior to processing a hydrocarbon feedstock, adding to the pyrolysis furnace an inhibiting compound selected from the group having the formlae:

I.

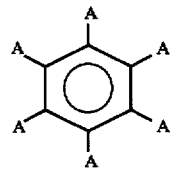

II.

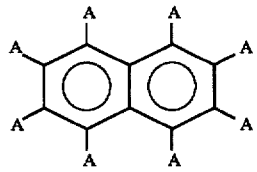

III.

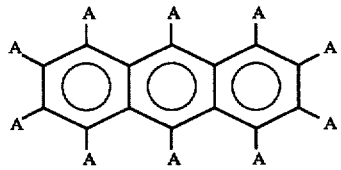

IV.

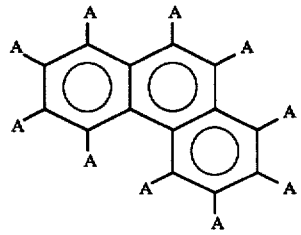

wherein A is selected from the group consisting of: hydrogen and Z; and at least one occurrence of A must be Z wherein Z is a substituent having the formula:

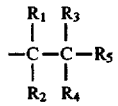

wherein $R_1$, $R_2$, $R_3$, $R_4$, and $R_5$ may be the same as or different from each other and are independently selected from the group consisting of: hydrogen, alkyl, alkene, cycloalkyl, alkyne, alkylaryl, aryl, arylalkyl, and substituents containing heteroatoms selected from the group consisting of nitrogen, oxygen, and sulfur wherein $R_1$, $R_2$, $R_3$, $R_4$, and $R_5$ each contain up to 15 carbon atoms, c. forming a thin catalytically inactive coke layer on the surfaces of the pyrolysis furnace and the surfaces immediately downstream of the furnace; and then, d. feeding the hydrocarbon feedstock to the furnace, whereby the surfaces of said furnace are inhibited against formation of a catalytically active coke during the processing of a hydrocarbon feedstock.

2. The method according to claim 1, wherein the inhibiting compound is in an organic solvent.

3. The method according to claim 1, wherein the inhibiting compound is in an aqueous solution.

4. The method according to claim 1, wherein the addition of the inhibiting compound is discontinued during processing the hydrocarbon feedstock.

5. The method according to claim 1, wherein the addition of the inhibiting compound is discontinued prior to processing the hydrocarbon feedstock.

6. The method according to claim 1, wherein the inhibiting compound is added intermittently prior to the processing of the hydrocarbon feedstock.

7. The method according to claim 1, wherein the inhibiting compound is added continuously prior to the processing of the hydrocarbon feedstock.

8. The method according to claim 1, wherein the inhibiting compound is added intermittently during the processing of the hydrocarbon feedstock.

9. The method according to claim 1, wherein the inhibiting compound is added continuously during the processing of the hydrocarbon feedstock.

10. The method according to claim 1, wherein the hydrocarbon feedstock contains at least one fraction selected from the group consisting of:

a. ethane;

b. propane;

c. butane;

d. naphtha;

e. kerosene; and, f. gas oil.

11. The method according to claim 1, wherein a thin catalytically inactive coke layer is formed on the surfaces in contact with the hydrocarbon feedstock downstream of the radiant heating section.

12. The method according to claim 1, wherein the inhibiting compound is added to the furnace in a carrier selected from the group consisting of:

a. steam;

b. hydrocarbon gases;

c. inert gases; and, d. mixtures thereof.

13. The method according to claim 1, wherein the inhibiting compound is added in a range of from about 100 ppm to about 50% on the basis of carrier mass flow prior to processing hydrocarbon feedstock.

14. The method according to claim 1, wherein the inhibiting compound is added in a range of from about 100 ppm to about 10% on the basis of hydrocarbon feedstock mass flow during the processing of the hydrocarbon feedstock.

15. The method according to claim 1, wherein during the addition of the inhibiting compound, the furnace is maintained at a temperature ranging from about 500 to about 1200° C.

16. The method according to claim 1, wherein during the addition of the inhibiting compound, the furnace is maintained at a temperature ranging from about 700° to about 1100° C.

17. A method for inhibiting the formation of coke on the surfaces of a radiant heating section of a pyrolysis furnace and the surfaces immediately downstream of such section in contact with hydrocarbon feedstock which comprises:

a. processing a hydrocarbon feedstock in the presence of an inhibiting compound selected from the group having the formlae:

I.

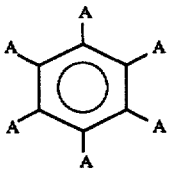

-continued

II.

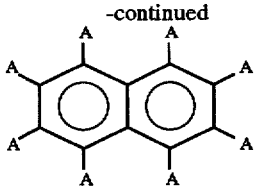

III.

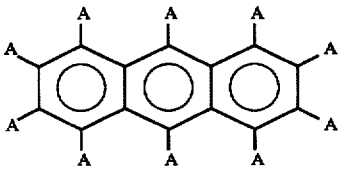

IV.

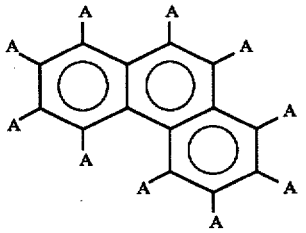

wherein A is selected from the group consisting of: hydrogen and Z; and at least one occurrence of A must be Z wherein Z is a substituent having the formula:

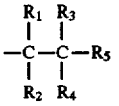

wherein $R_1$, $R_2$, $R_3$, $R_4$, and $R_5$ may be the same as or different from each other and are independently selected from the group consisting of: hydrogen, alkyl, alkene, cycloalkyl, alkyne, alkylaryl, aryl, arylalkyl, and substituents containing heteroatoms selected from the group consisting of nitrogen, oxygen, and sulfur wherein $R_1$, $R_2$, $R_3$, $R_4$, and $R_5$ each contain up to 15 carbon atoms; and, b. forming a catalytically inactive thin coke layer on the surfaces of the pyrolysis furnace, whereby the surfaces of the furnace are inhibited against formation of a catalytically active coke during the processing of a hydrocarbon feedstock.

18. The method according to claim 17, wherein the inhibiting compound is in an organic solvent.

19. The method according to claim 17, wherein the inhibiting compound is in an aqueous solution.

20. The method according to claim 17, wherein the inhibiting compound is added intermittently during the processing of the hydrocarbon feedstock.

21. The method according to claim 17, wherein the inhibiting compound is added continuously during the processing of the hydrocarbon feedstock.

22. The method according to claim 17, wherein the hydrocarbon feedstock contains at least one fraction selected from the group consisting of:

a. ethane;

b. propane;

c. butane;

d. naphtha;

e. kerosene; and, f. gas oil.

23. The method according to claim 17, wherein a thin catalytically inactive coke layer is formed on the surfaces in contact with the hydrocarbon feedstock downstream of the radiant heating section.

24. The method according to claim 17, wherein the inhibiting compound is added in a range of from about 100 ppm to about 10% on the basis of hydrocarbon feedstock mass flow during the processing of the hydrocarbon feedstock.

25. The method according to claim 17, wherein during the addition of the inhibiting compound, the furnace is maintained at a temperature ranging from about 500° to about 1200° C.

26. A method for increasing the run length of the pyrolysis furnace used to process a hydrocarbon feedstock which comprises:

a. decoking pyrolysis furnace;

b. prior to processing a hydrocarbon feedstock, adding to the pyrolysis furnace an inhibiting compound selected from the group having the formlae:

I.

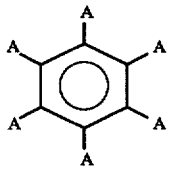

II.

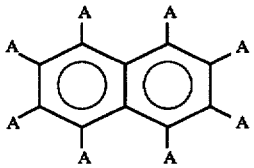

III.

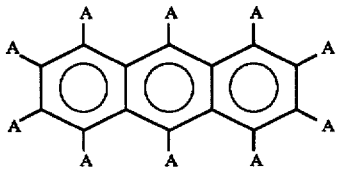

IV.

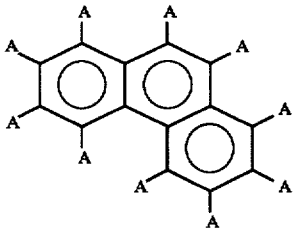

wherein A is selected from the group consisting of: hydrogen and Z; and at least one occurrence of A must be Z wherein Z is a substituent having the formula:

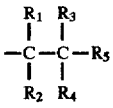

wherein $R_1$, $R_2$, $R_3$, $R_4$, and $R_5$ may be the same as or different from each other and are independently selected from the group consisting of: hydrogen, alkyl, alkene, cycloalkyl, alkyne, alkylaryl, aryl, arylalkyl, and substituents containing heteroatoms selected from the group consisting of nitrogen, oxygen, and sulfur wherein $R_1$, $R_2$, $R_3$, $R_4$, and $R_5$ each contain up to 15 carbon atoms;

c. forming a thin catalytically inactive coke layer on the surfaces of the pyrolysis furnace in contact with the hydrocarbon feedstock; and then, d. feeding the hydrocarbon feedstock to the furnace, whereby the surfaces of said furnace are inhibited against formation of a catalytically active coke during the processing of the hydrocarbon feedstock thereby increasing the run length of the pyrolysis furnace.

27. A method for increasing the product yield from the processing of a hydrocarbon feedstock through a pyrolysis furnace which comprises:

a. decoking pyrolysis furnace;

b. prior to processing a hydrocarbon feedstock, adding to the pyrolysis furnace an inhibiting compound selected from the group having the formlae:

I.

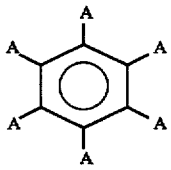

II.

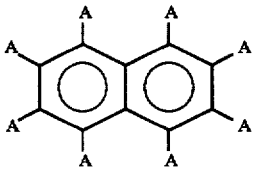

III.

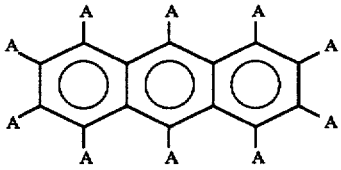

IV.

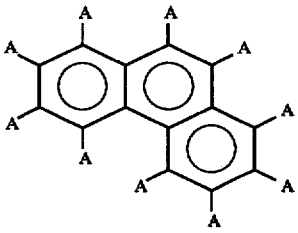

wherein A is selected from the group consisting of: hydrogen and Z; and at least one occurrence of A must be Z wherein Z is a substituent having the formula:

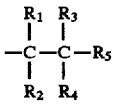

wherein $R_1$, $R_2$, $R_3$, $R_4$, and $R_5$ may be the same as or different from each other and are independently selected from the group consisting of: hydrogen, alkyl, alkene, cycloalkyl, alkyne, alkylaryl, aryl, arylalkyl, and substituents containing heteroatoms selected from the group consisting of nitrogen, oxygen, and sulfur wherein $R_1$, $R_2$, $R_3$, $R_4$, and $R_5$ each contain up to 15 carbon atoms;

c. forming a thin catalytically inactive coke layer on the surfaces of the pyrolysis furnace in contact with the hydrocarbon feedstock; and then, d. feeding the hydrocarbon feedstock to the furnace, whereby the surfaces of said furnace are inhibited against formation of a catalytically active coke during the processing of the hydrocarbon feedstock thereby increasing the product yield from the processing of the hydrocarbon feedstock through the pyrolysis furnace.

28. The method of claim 1 wherein A is selected form the group consisting of hydrogen and Z and at least one occurrence of A must be Z, wherein Z is a substituent having the formula:

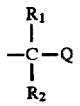

wherein Q is selected from the group consisting of: $NR_3R_4$, S—$R_3$, O—$R_3$, hydrogen, alkyl, alkene, cycloalkyl, alkyne, alkylaryl, aryl, arylalkyl, and substituents containing heteroatoms selected from the group consisting of nitrogen, oxygen, and sulfur and wherein $R_1$, $R_2$, $R_3$, and $R_4$ may be the same as or different from each other and are independently selected from the group consisting of: hydrogen, alkyl, alkene, cycloalkyl, alkyne, alkylaryl, aryl, arylalkyl, and substituents containing heteroatoms selected from the group consisting of nitrogen, oxygen, and sulfur and wherein $R_1$, $R_2$, $R_3$, $R_4$, and Q each contain up to 15 carbon atoms and $R_1$, $R_2$, and Q are not all a hydrogen atom at the same time.

29. The method of claim 17 wherein A is selected form the group consisting of hydrogen and Z and at least one occurrence of A must be Z, wherein Z is a substituent having the formula:

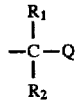

wherein Q is selected from the group consisting of: $NR_3R_4$, S—$R_3$, O—$R_3$, hydrogen, alkyl, alkene, cycloalkyl, alkyne, alkylaryl, aryl, arylalkyl, and substituents containing heteroatoms selected from the group consisting of nitrogen, oxygen, and sulfur and wherein $R_1$, $R_2$, $R_3$, and $R_4$ may be the same as or different from each other and are independently selected from the group consisting of: hydrogen, alkyl, alkene, cycloalkyl, alkyne, alkylaryl, aryl, arylalkyl, and substituents containing heteroatoms selected from the group consisting of nitrogen, oxygen, and sulfur and wherein $R_1$, $R_2$, $R_3$, $R_4$, and Q each contain up to 15 carbon atoms and $R_1$, $R_2$, and Q are not all a hydrogen atom at the same time.

* * * * *